United States Patent [19]

Yan et al.

[11] 4,278,292

[45] Jul. 14, 1981

[54] CLAY STABILIZATION IN URANIUM LEACHING AND RESTORATION

[75] Inventors: Tsoung-yuan Yan, Philadelphia, Pa.; Wilton F. Espenscheid, DeSoto, Tex.

[73] Assignee: Mobil Oil Corporation, New York, N.Y.

[21] Appl. No.: 21,400

[22] Filed: Mar. 19, 1979

[51] Int. Cl.[3] ..... E21B 43/28; E02D 3/12

[52] U.S. Cl. ..... 299/5; 405/263

[58] Field of Search ..... 299/4, 5; 405/263

[56] References Cited

U.S. PATENT DOCUMENTS

| | | | |
|---|---|---|---|
| 4,079,783 | 3/1978 | Snavely et al. | 299/4 X |
| 4,114,693 | 9/1978 | Foster et al. | 299/4 X |
| 4,134,618 | 1/1979 | Kossack | 299/5 |

FOREIGN PATENT DOCUMENTS

| | | | |
|---|---|---|---|
| 1323808 | 7/1973 | United Kingdom | 405/263 |
| 1357603 | 6/1974 | United Kingdom | 405/263 |

OTHER PUBLICATIONS

Coppel et al., "Field Results from Wells Treated with Hydroxy-Aluminum", Journal of Petroleum Technology, Sep. 1973, pp. 1108-1112.

Reed, "Stabilization of Formation Clays with Hydroxy-Aluminum Solutions", Journal of Petroleum Technology, Jul. 1972, pp. 860-864.

*Primary Examiner*—Ernest R. Purser

*Attorney, Agent, or Firm*—Charles A. Huggett; Michael G. Gilman; James F. Powers, Jr.

[57] ABSTRACT

Process for the stabilization of formation clays by the use of aluminum in the in-situ leaching of uranium or the restoration of contaminated formations. The aluminum is added to a lixiviant having a pH in the range of 6-10 or to a restoration fluid having a pH of at least 6 in an amount effective for the stabilization of clays.

4 Claims, 2 Drawing Figures

CLAY STABILIZATION IN URANIUM LEACHING AND RESTORATION

BACKGROUND OF THE INVENTION

This invention relates to the recovery of uranium from subterranean ore deposits and more particularly to the stabilization of clays in such subterranean deposits during in-situ leaching or restoration operations.

In the in-situ leaching of subterranean uranium ore deposits, a lixiviant containing a leaching agent is introduced into the subterranean deposit through a suitable injection system. The lixiviant solubilizes uranium values as it traverses the ore body. The pregnant lixiviant is then withdrawn from the ore body through a production system and treated to recover the uranium therefrom by any suitable technique such as adsorption and elution employing an ion exchange resin and subsequent precipitation.

The lixiviants employed in the in-situ leaching operations may generally be classified as containing a carbonate or an acidic leaching agent. In acid leaching, the most commonly employed acid is sulfuric acid added in an amount to provide a pH in the lixiviant of about 2 or less. Carbonate lixiviants contain carbonate or bicarbonate ions or mixtures thereof which function to complex the uranium in the form of water-soluble uranyl carbonate ions. The carbonate lixiviants may be formulated by the addition of alkali metal or ammonium carbonates and/or bicarbonates or by the addition of carbon dioxide together, in most cases, with an alkaline agent, e.g. sodium hydroxide or ammonia, to control the pH.

Many subterranean uranium deposits contain substantial quantities of clays which base exchange with the alkali metal or ammonium ions present in the lixiviant. Where the lixiviant contains an ammonium carbonate and/or bicarbonate leaching agent, the ammonium ions adsorbed by the clays are a potential source of contamination to fresh ground waters. Thus, it is a conventional practice to treat the formation at the conclusion of the leaching operation to restore it to an environmentally acceptable state. For example, U.S. Pat. No. 4,079,783 to Snavely et al. discloses a process for removing uranium ions from a subterranean formation by the injection of a restoration fluid comprising an aqueous solution of a strong base such as sodium or calcium hydroxide. The ammonium ions are desorbed from the clay surfaces by base exchange with the sodium or calcium ions and are partially converted to ammonia which is not subject to adsorption and thus is produced to the surface. In another procedure disclosed in U.S. Pat. No. 4,162,707 to Yan, a halogenated restoration fluid is injected into the formation. The restoration fluid may take the form of chlorinated water or an aqueous solution of a hypochlorite such as sodium hypochlorite. The ammonium ions are desorbed from the clay surfaces and the ammonia formed in equilibrium with the ammonium ions reacts in the chlorinated water to form trichloroamine.

In many cases, the clays found in the subterranean formation present problems not only from the standpoint of providing adsorption sites but also because they are unstable in the presence of the injected aqueous solution, that is, they become hydrated and through one or more of a number of mechanisms tend to plug the formation, thus reducing its permeability. A process for avoiding such permeability reduction during a restoration procedure is disclosed in U.S. Pat. No. 4,114,693 to Foster et al. In this process, the restoration fluid contains a strong base as described in the aforementioned patent to Snavely et al. and in addition contains an effective amount of a monovalent salt such as sodium chloride. The salt functions to retard clay swelling in the presence of a restoration fluid, thus avoiding a decrease in permeability during the restoration operation.

As noted in U.S. Pat. No. 4,134,618 to Kossack, in-situ leaching operations may result in contaminants other than ammonium ions being left in the formation. Thus, at the conclusion of a leaching operation employing either an acidic or alkaline leaching solution, the formation may contain unacceptable amounts of water-soluble contaminants such as sulfates and oxidized uranium and molybdenum values. The patent to Kossack proposes a restoration process which involves the cycling of water low in total dissolved solids through the formation.

SUMMARY OF THE INVENTION

The present invention relates to the stabilization of formation clays in conjunction with the in-situ leaching of uranium and the restoration of formations contaminated with ammonium ions or other possible fresh water pollutants such as oxidized uranium or molybdenum minerals. In one aspect of the invention, a fresh lixiviant is introduced via a suitable injection system into a subterranean uranium deposit containing unstable clays. The lixiviant solubilizes uranium from the deposit to form pregnant lixiviant which is then produced from the deposit via a suitable production system. At least a portion of the fresh lixiviant injected into the deposit is an aqueous solution of a carbonate leaching agent having a pH within the range of 6–10. This solution contains aluminum in an amount effective for the stabilization of the clays. In a further aspect of the invention in which a subterranean formation containing unstable clays having ammonium ions adsorbed on the clay surfaces is flushed with a restoration fluid having a pH of at least 7, aluminum is incorporated into the restoration fluid in an amount effective for the stabilization of the clays.

DESCRIPTION OF SPECIFIC EMBODIMENTS

Figure 1:
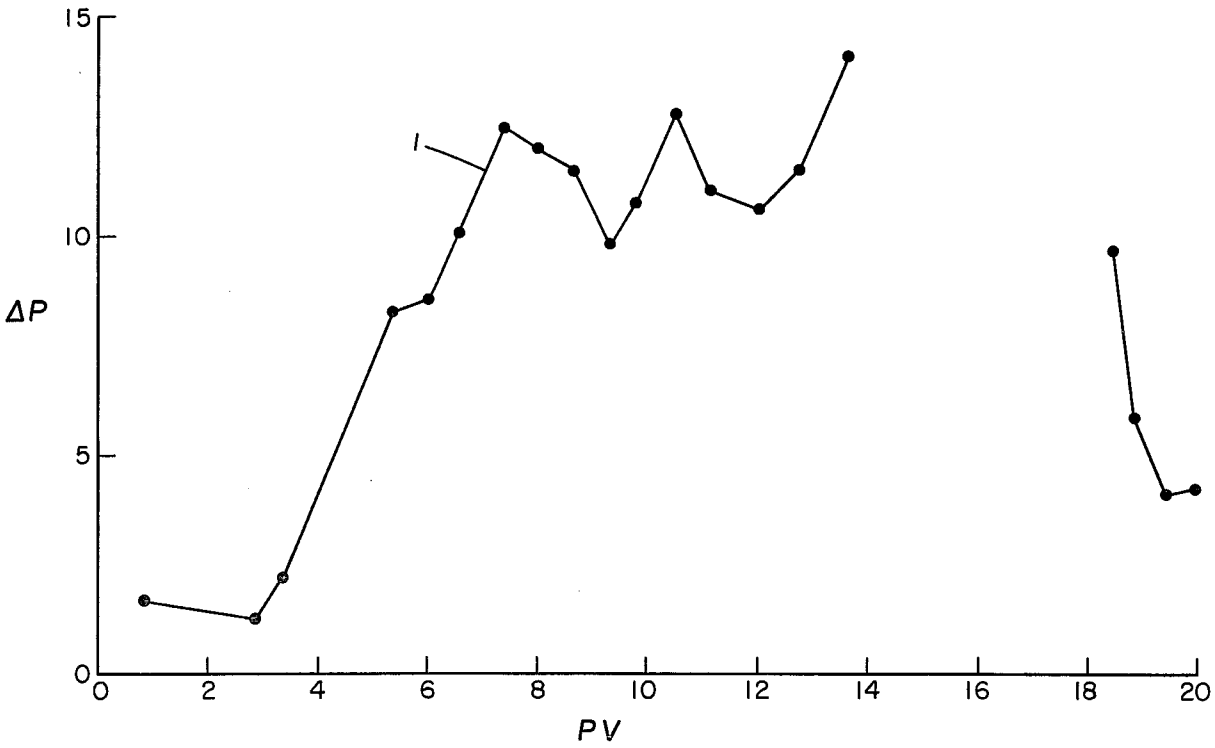
FIGS. 1 and 2 are graphs showing the effect of addition of the aluminum ion on the pressure drop across columns employed in leaching and restoration experiments.

In the in-situ leaching of uranium with a carbonate leaching agent, the pH of the lixiviant normally will be within the range of about 7–9 although it may be as low as 6 (where an excess of carbon dioxide is added to form carbonic acid) or as high as about 10. The carbonate leaching agent may take the form of alkali metal or ammonium carbonates and/or bicarbonates or mixtures thereof in any suitable concentration typically within the range of about 0.1–0.5 weight percent. The lixiviant will contain a mixture of carbonate and bicarbonate ions in an equilibrium condition depending upon the pH of the lixiviant. The lixiviant also contains a suitable oxidizing agent such as air, oxygen, hydrogen peroxide, or sodium chlorate. As will be understood by those skilled in the art, the oxidizing agent functions to oxidize the uranium from the insoluble tetravalent state to the soluble hexavalent state so that the uranium is complexed in the form of the water-soluble uranyl di- or tri-carbonate ion.

The unstable clays typically found in uranium-bearing formations include expandable or dispersible clays such as those found in the kaolinite, montmorillonite, and illite groups. Serious permeability losses in the formation can occur when the chemical composition of the injected lixiviant is significantly different from that of the connate water. Permeability reduction may occur because the clay expands by absorbing water between the clay layers and plugs or partially plugs the pore spaces in the rock. Another important mechanism by which formation permeability may be reduced is by particle dispersion and migration. As the clay absorbs water, particles become dispersed in flow channels within the formation and are carried downstream until they lodge in constrictions. Through this mechanism, only small amounts of clay can cause a serious reduction in the permeability of the formation.

The problems presented by hydratable clays are well known in the petroleum production art and various palliative procedures have been proposed. One promising technique involves the use of hydroxy-aluminum as described in Reed, "Stabilization of Formation Clays with Hydroxy-Aluminum Solutions", Journal of Petroleum Technology, July 1972, pp. 860–864, and Coppel, et al., "Field Results From Wells Treated With Hydroxy-Aluminum", Journal of Petroleum Technology, September 1973, pp. 1108–1112. In this procedure, a suitable salt, e.g. aluminum chloride as disclosed in Reed, is dissolved in water where it hydrolyzes to form an acidic solution. The solution remains acidic (at a pH of about 4–5) with the addition of a suitable base such as sodium hydroxide until the OH/Al ratio approaches 3. The insoluble product, $Al(OH)_3$, has little affinity for additional OH and the solution pH increases sharply as additional sodium hydroxide is added. At a pH higher than about 11, the insoluble aluminum hydroxide redissolves to form water-soluble aluminate ions.

As described in Reed and Coppel et al., about 0.1 to 0.3 molar solutions of hydroxy-aluminum are employed in clay stabilization at a pH of about 4–5 and an OH/Al ratio of about 2. At this ratio, the hydroxy-aluminum solution contains 6-membered units with a relatively high positive charge which causes them to adsorb tightly on the negatively charged clay surfaces. The affinity of the polynuclear hydroxy-aluminum ions for the clay increases with age and the clays become quite stable with little tendency to disperse and cause permeability damage.

The present invention derives from the discovery that aluminum may be employed as an effective clay stabilizing agent in uranium leaching operations, notwithstanding that the solution pH is well above that associated with the OH/Al ratio described above. Furthermore, the aluminum ion is effective in only modest amounts. Thus, ionic aluminum species containing aluminum at a concentration of 10 parts per million or less may be employed.

In experimental work relative to the present invention, column leaching tests were carried out to simulate leaching and restoration operations. In the column tests, uranium ore from a subterranean uranium formation was packed into a glass tube having an internal diameter of $\frac{7}{8}$ inch and a length of 34 inches. Fresh lixiviant was injected into the column at one end and the pregnant lixiviant recovered from the other. The column was maintained at a pressure of about 150 psig. A manometer was employed to measure the pressure drop across the pack.

Figure 2:
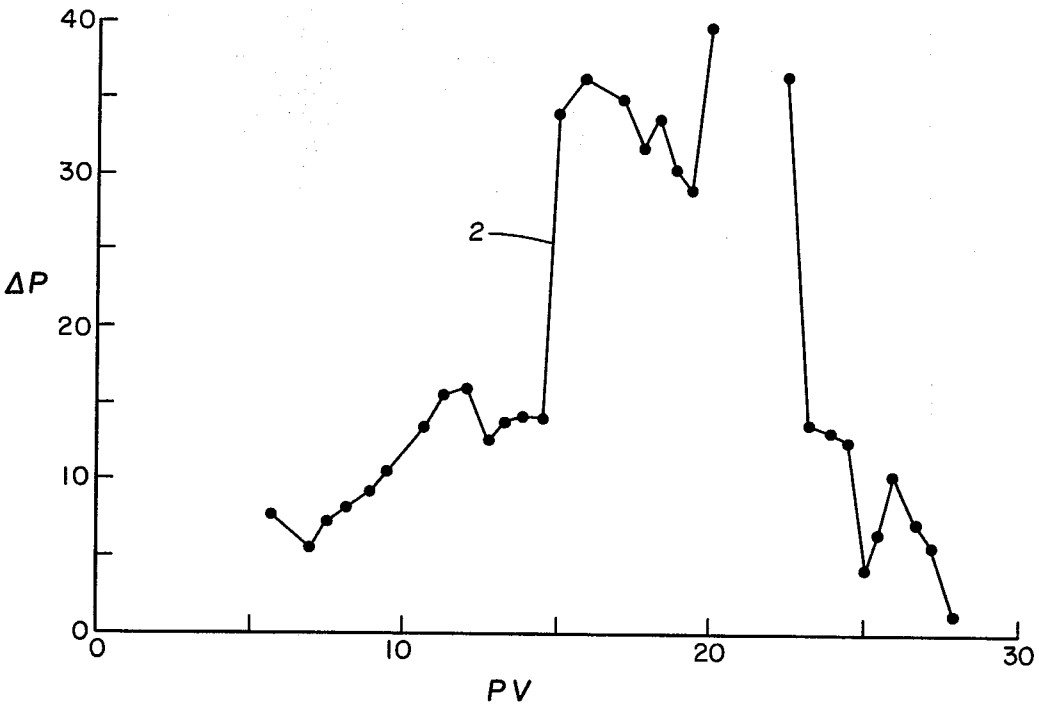

Two column tests were run and the results of these tests are shown respectively in FIGS. 1 and 2. In each of these figures, the curves are graphs of the pressure, $\Delta P$, differential between the inlet and outlet ends in millimeters of mercury plotted on the ordinate versus the pore volumes, PV, of solution injected plotted on the abscissa. In the first experiment, shown in FIG. 1, the lixiviant was an aqueous solution containing 2.1 grams per liter of sodium bicarbonate and 1.0 gram per liter of sodium chloride. The lixiviant was injected at a rate of 30 cubic centimeters per day (equivalent to 0.2 pore volume per day). The fresh lixiviant had a pH of about 8. The lixiviant was initially injected without oxidizing agent and after the injection of 5.4 pore volumes, oxygen under a pressure of 150 psig was then added to the lixiviant. After the injection of about 11 pore volumes, 10 parts per million of aluminum sulfate, $Al_2(SO_4)_3.16H_2O$, were added to the lixiviant to give an aluminum concentration of 0.9 part per million.

The pressure differential across the column during this experiment is illustrated by curve 1 of FIG. 1. During the early stages of the leaching procedure, the pressure differential increased by an order of magnitude, indicating significant permeability damage due to hydration of the unstable clays. During the interval from 13.6 to 18.4 pore volumes, the manometer was inoperative and thus no pressure points are shown in this interval. However, from an examination of FIG. 1, it can be seen that when the manometer came back on stream, the pressure differential had already started to decline and by the time 19 to 20 pore volumes of lixiviant had been injected the pressure differential across the pack had declined to about 4 millimeters of mercury. Thus, it can be seen that the addition of even a small quantity of aluminum reversed the permeability reduction which had occurred during the early stages of the leaching procedure.

In the second column test, the lixiviant employed was again an aqueous solution of 2.1 grams per liter of sodium bircarbonate and 1.0 gram per liter of sodium chloride. The pH was 8. The oxidizing agent employed in this test was hydrogen peroxide. In carrying out the test, an initial 7.5 pore volumes of lixiviant were injected without oxidizing agent. Thereafter, the hydrogen peroxide was added to the fresh lixiviant in a concentration of 833 parts per million.

As can be seen by an examination of curve 2 of FIG. 2, the permeability of the uranium ore progressively decreased as indicated by the rising pressure differential. After the injection of about 13.5 pore volumes of fresh lixiviant, 10 parts per million of a polymer were added to the fresh lixiviant to test its effectiveness as a stabilizing agent. The polymer was a partially hydrolyzed polyacrylamide available from the Dow Chemical Company under the trade name "Dow Pusher 500".

Shortly after the addition of the polymer, the pressure gradient curve rose steeply, indicative of a sharp reduction in permeability. After the injection of about 15 pore volumes of lixiviant, 20 parts per million of aluminum sulfate were added to provide an aluminum ion concentration of 1.7 parts per million. Shortly after injection of aluminum ion was initiated, the pressure differential started to decline and, after a short period of increase, continued its decline to less than 5 millimeters of mercury. During the period from 20 to 22.5 pore volumes, the manometer was inoperative.

At the conclusion of 25 pore volumes, the injection of lixiviant into the column was terminated and the rest of the experiment was run to simulate a restoration operation, again employing aluminum ion as a clay stabilizing agent. The restoration fluid was an aqueous solution of 0.2 normal sodium hydroxide and 0.3 normal sodium chloride. The pH of the solution was about 13.5. Aluminum sulfate was added to the restoration fluid from the beginning in an amount of 20 parts per million, corresponding to an aluminum concentration of 3 parts per million. The restoration fluid was injected at a rate of 0.4 pore volume per day. As can be seen from an examination of curve 2, the pressure drop during the restoration operation, after an initial decrease, again declined to a value of about 1 millimeter of mercury.

The invention may be carried out utilizing injection and production systems as defined by any suitable well arrangement. One well arrangement suitable for use in carrying out the invention is a five-spot pattern in which a central injection well is surrounded by four production wells. Other patterns such as seven-spot and nine-spot patterns also may be employed as well as the so-called "line flood" pattern in which injection and production wells are located in generally parallel rows. Typically the spacing between injection and production wells will be on the order of 50 to 200 feet. In some instances, particularly where the subterranean uranium deposit is of a limited areal extent, injection and production may be carried out through the same well. Thus, in relatively thick uranium deposits, dually completed injection-production wells of the type disclosed, for example, in U.S. Pat. No. 2,725,106 to Spearow may be employed. Alternatively, injection of fresh lixiviant and withdrawal of pregnant lixiviant through the same well may be accomplished by a "huff-and-puff" procedure employing a well system such as disclosed in U.S. Pat. No. 3,708,206 to Hard et al.

Where the subterranean ore deposit is known to contain significant quantities of unstable clays, the aluminum ion stabilizing agent may be added to the lixiviant at the start of the leaching operation. However, it may be incorporated at a later stage during the operation since as indicated by the above-described experimental work the aluminum is at least partially effective in reversing formation damage. The aluminum may be added in the form of any suitable water-soluble salt such as aluminum chloride, aluminum nitrate, aluminum sulfate, aluminum hydroxide, or sodium or potassium aluminates.

In the application of the present invention to formation restoration, the aluminum stabilizing agent may be added to all or part of any suitable restoration fluid such as those disclosed in the aforementioned patents to Snavely et al., Foster, and Kossack and the aforementioned application by Yan. The pH of the restoration fluid may vary over a significantly wider range than normally encountered in the carbonate lixiviants. In the case of the procedure described in the aforementioned patent to Snavely et al., the restoration fluid normally will have a relatively high pH on the order of about 12 to 14. Where a halogenated restoration fluid is employed, the water may be strongly basic (up to a pH of about 13) or it may be neutral (pH 7) as described in greater detail in the Yan application. When a procedure such as disclosed in the patent to Kossack is employed, the restoration fluid may be any available relatively fresh water which normally will have a neutral or near neutral pH of about 6 to 8. In carrying out the restoration procedure, the restoration fluid may be injected in any suitable amount until analysis of the produced effluent from the formation indicates that the formation has been restored to an environmentally acceptable state. Typically, at least 2 pore volumes of restoration fluid will be injected during this procedure although the quantity may range up to 30 or more pore volumes.

The amount of aluminum required for effective clay stabilization can be determined by laboratory experiments carried out on samples of the formation involved. At the near neutral or mildly alkaline pH's within the range of 6–10, normally encountered in carbonate lixiviants, only small amounts of aluminum are required for clay stabilization. The aluminum concentration in the lixiviant normally need not exceed 10 parts per million and smaller concentrations, down to about 0.1 part per million, often will be adequate. Where strongly basic restoration fluid is employed, higher aluminum concentrations normally will be desirable since the high pH environment increases the expansion of the clays. In this case, the required aluminum concentration may be about 20 parts per million or more although lower concentrations of about 2 parts per million may be adequate.

We claim:

1. In a method for the recovery of uranium from a subterranean uranium deposit containing unstable clays wherein a fresh lixiviant is introduced into said deposit via an injection system to solubilize uranium from said deposit to form pregnant lixiviant which is then produced from said deposit via a production system, the improvement comprising:

employing as at least a portion of said fresh lixiviant an aqueous solution of a carbonate leaching agent having a pH within the range of 6–10 and containing aluminum in an amount effective for the stabilization of said clays.

2. The method of claim 1 wherein said solution contains aluminum in a concentration no greater than 10 parts per million.

3. In a method for the restoration of a subterranean formation containing water-soluble contaminants resulting from the in-situ leaching of said formation and wherein said formation contains unstable clays and is flushed with an aqueous restoration fluid having a pH of at least 6 which functions to reduce the contaminants in said formation, the improvement comprising incorporating aluminum into said restoration fluid in an amount effective for the stabilization of said clays.

4. In a method for the restoration of a subterranean formation containing unstable clays having ammonium ions adsorbed on the clay surfaces wherein said formation is flushed with an aqueous restoration fluid having a pH of at least 6 which functions to desorb said ammonium ions from said clay surfaces, the improvement comprising incorporating aluminum into said restoration fluid in an amount effective for the stabilization of said clays.

* * * * *